US007846077B2

(12) United States Patent
Osbak

(10) Patent No.: US 7,846,077 B2
(45) Date of Patent: Dec. 7, 2010

(54) OBLIQUE ABDOMINAL TRAINER

(76) Inventor: Gordon Albin Osbak, Box 154, Caley, Alberta (CA) T0L 0P0

( * ) Notice: Subject to any disclaimer, the term of this patent is extended or adjusted under 35 U.S.C. 154(b) by 20 days.

(21) Appl. No.: 12/382,409

(22) Filed: Mar. 16, 2009

(65) Prior Publication Data

US 2009/0239720 A1 Sep. 24, 2009

Related U.S. Application Data

(63) Continuation-in-part of application No. 11/785,640, filed on Apr. 19, 2007, now abandoned.

(51) Int. Cl.
*A63B 21/015* (2006.01)
*A63B 21/008* (2006.01)
*A63B 21/04* (2006.01)

(52) U.S. Cl. ..... 482/115; 482/112; 482/129

(58) Field of Classification Search ..... 482/12, 482/44–51, 62, 70–71, 90, 92, 111–119, 482/121, 127–129, 135, 140, 905, 907; 601/23, 601/33; 473/441–445; 434/249; *A63B 21/012, A63B 21/015, 21/02, 21/04, 21/008*
See application file for complete search history.

(56) References Cited

U.S. PATENT DOCUMENTS

| | | | | | |
|---|---|---|---|---|---|
| 3,421,760 | A * | 1/1969 | Freeman, Jr. | ..... | 482/80 |
| 3,428,311 | A * | 2/1969 | Mitchell | ..... | 482/45 |
| 3,997,160 | A * | 12/1976 | George | ..... | 473/444 |
| 4,640,268 | A * | 2/1987 | Roberts | ..... | 601/24 |
| 4,653,749 | A * | 3/1987 | Rorabaugh | ..... | 482/71 |
| 4,911,430 | A * | 3/1990 | Flament | ..... | 482/71 |
| 7,108,641 | B2 * | 9/2006 | Pertegaz-Esteban | ..... | 482/139 |

* cited by examiner

*Primary Examiner*—Loan Thanh
*Assistant Examiner*—Oren Ginsberg
(74) *Attorney, Agent, or Firm*—Antony C. Edwards

(57) ABSTRACT

An apparatus for exercising the abdominal muscles of a user includes an elongate track having first and second ends and a middle portion wherein the elongate track is positionable transverse to a user. The apparatus further includes a carriage movable along the track, wherein that carriage is biased toward the middle portion of the track, and an arm extending substantially perpendicular from the carriage. The arm has a free distal end such that application by user of an alternating torque to the free distal end of the arm urges the carriage in a corresponding reciprocating motion on the track.

18 Claims, 13 Drawing Sheets

SECTION 4-4
SCALE 1 : 2

SECTION 7-7
SCALE 1 : 3

OBLIQUE ABDOMINAL TRAINER

CROSS REFERENCE TO RELATED APPLICATION

This application is a Continuation-In-Part of U.S. patent application Ser. No. 11/785,640 filed Apr. 19, 2007 now abandoned entitled Oblique Abdominal Trainer.

FIELD OF THE INVENTION

The present invention relates to exercise equipment in general and in particular to an apparatus for exercising the oblique abdominal muscles of a user.

BACKGROUND OF THE INVENTION

Abdominal muscles are important muscles of a human body for both performing specific motions such as bending or twisting, for example, as well as for stabilizing the torso of a person during other activities. It is an important aspect of increasing the fitness level of a person to exercise the abdominal muscles so that they may properly stabilize the torso during activity as well as provide the necessary range of mobility required.

Abdominal muscles are commonly divided into three main muscles groups, the rectus abdominis, the transversus abdominis and the obliques. The obliques include both the internal oblique and the external oblique muscles (hereinafter collectively called the "obliques") and serve to rotate and side-bend the torso of the person as well as to stabilize and reduce the volume of the person during exhaling a breath. The transversus abdominis provide stability to the torso and help to compress the ribs during exhaling.

Exercises for the obliques and the transversus abdominis commonly include twisting, side crunches, and side bends. Twisting motions typically do not incorporate any type of resistance to the twisting motion and are therefore of limited effectiveness. In addition, side crunches and side bends are known to also rely on and utilize the hip flexors of the person when performing this exercise.

Using the hip flexors during abdominal muscle exercises is not desirable in certain circumstances for several reasons. The use of the hip flexors during an exercise reduces the isolation of the abdominal muscles and therefore reduces the effectiveness of the abdominal muscle training. In addition, when the exercise is for the purpose of rehabilitating a person, the use of the hip flexors to complete the exercise may exacerbate an existing injury.

What is desirable is a method and apparatus for exercising the oblique and transversus abdominis muscles of a user as well as the transversus abdominis that permits an adjustable resistance. The desired method and apparatus will also not substantially utilize the hip flexors of the user.

SUMMARY OF THE INVENTION

The present invention provides a method and apparatus for exercising the oblique and transversus abdominis muscles of a user without substantially exercising the hip flexors and includes a variable resistance.

According to a first embodiment of the present invention there is provided an apparatus for exercising the abdominal muscles of a user. The apparatus comprises a body and guide means for guiding the body along a path. The guide means has first and second ends and a middle portion. The apparatus further comprises biasing means for biasing the body towards the middle portion of the guide means and transmitting means for transmitting alternating torso rotational movements of a user to the body so as to urge the body in reciprocating opposite directions along the path. The apparatus may further comprise resistance means for resisting movement of the body along the guide means.

According to a further embodiment of the present invention there is provided an apparatus for exercising the oblique abdominal muscles of a user. The apparatus comprises an elongate track having first and second ends and a middle portion wherein the elongate track is positionable transverse to a user. The apparatus further includes a carriage movable along the track, wherein that carriage is biased toward the middle portion of the track, and an arm extending substantially perpendicular from the carriage. The arm has a free distal end such that application by user of an alternating torque to the free distal end of the arm urges the carriage in a corresponding reciprocating motion on the track.

The elongate track may have a curvature. The middle portion may be lower than the ends of the track. The track may be arcuate. The curvature of the track may have a constant radius. The track may have an adjustable height. The track may comprise a pair of parallel spaced apart rails. The rails further may include parallel spaced apart support portions for supporting the carriage.

The arm may extend from the carriage through a passage between the pair of rails. The carriage may further include sliders slidably engaging the track. The arm may be pivotally connected to the carriage. The arm may further include a handle at the distal end. The handle may be rotatably secured to the arm. The handle may be pivotally and substantially collinearly secured to the arm.

The carriage may further include wheels rollably engaging the track. The carriage may include support wheels and clamping wheels with the support portion retained therebetween. At least one of the support wheels or the clamping wheels may comprise a pliable material. The clamping wheels may comprise a pliable material. The pliable material may comprise polyurethane.

The apparatus may further include a resistor for resisting the movement of the carriage along the path. The resistor may comprise a friction inducing means between the track and the carriage. The resistor may comprise retaining at least a portion of the track between at least two wheels, at least one of the at least two wheels having a rolling resistance on the track. The at least one of the at least two wheels may be adjustably engaged upon the track. This variable resistance may thus be used progressively so as to allow increased resistance corresponding to a commensurate increase in strength and fitness of a user as a result of use.

The apparatus may further comprise a biasing element for biasing the carriage towards the middle portion of the track. The biasing element may be selected from the group consisting of springs, elastomeric bands or pneumatic or hydraulic cylinders.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION OF EMBODIMENTS OF THE INVENTION

Figure 1:
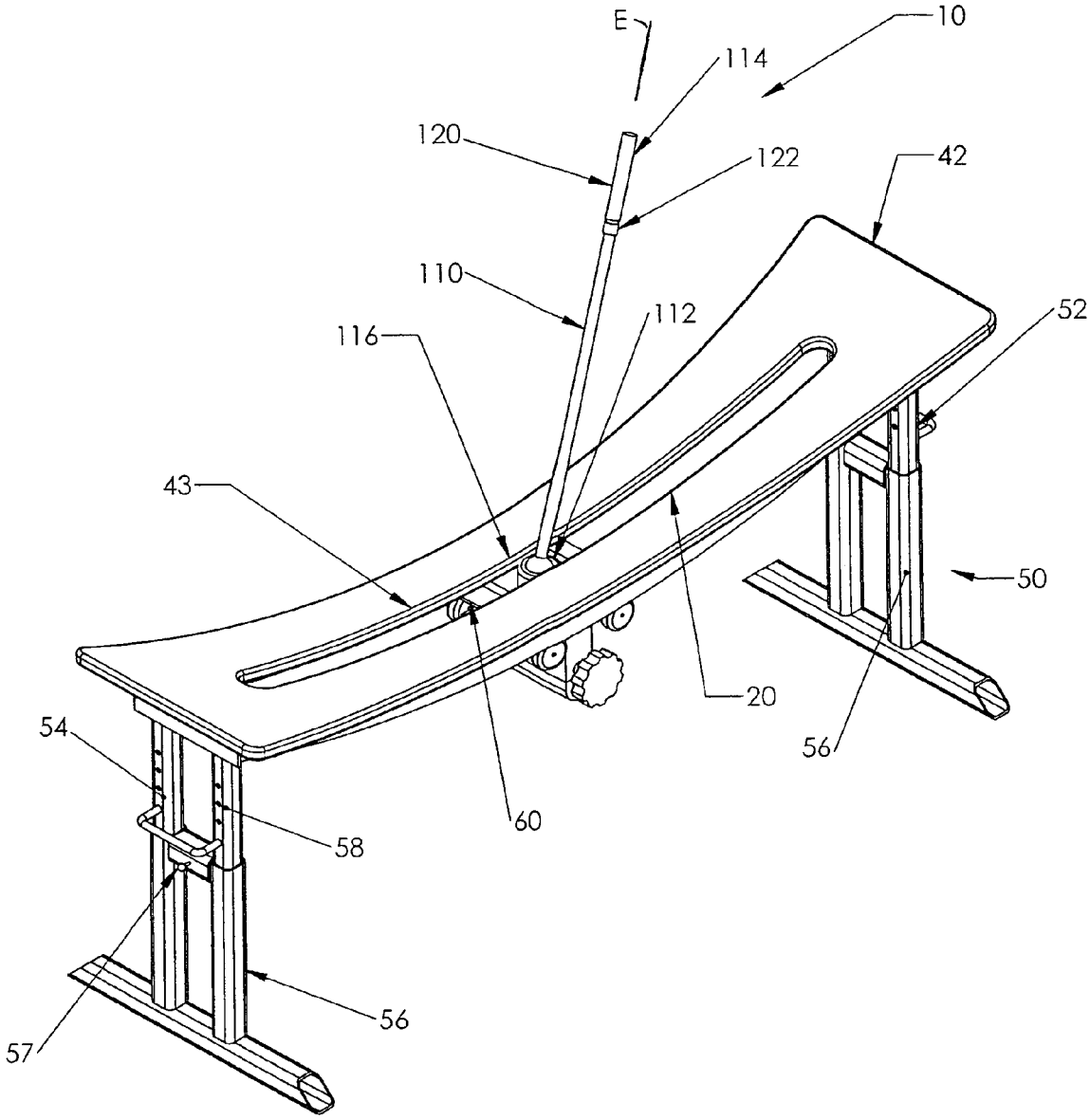
FIG. 1 is an isometric perspective view of an exercise apparatus according to a first embodiment of the present invention.

Referring to FIG. 1, an exercise apparatus according to a first embodiment of the invention is shown generally at 10. The exercise apparatus 10 comprises an elongate track or guide 20, a carriage 60 movable on the track and an arm 110 extending from the moveable carriage 60. The track 20 is supported by a frame 50 and provides a path of motion for the movable carriage 60. The arm 110 extends pivotally from the carriage 60. As illustrated in FIG. 1, the track 20 may include a top bed 42 having an elongate opening 43 along the length of the track 20. A user translates the carriage along the track by grasping and manipulating the arm. An adjustable resistance means in the carriage provides resistance to the user induced translation.

Figure 2:
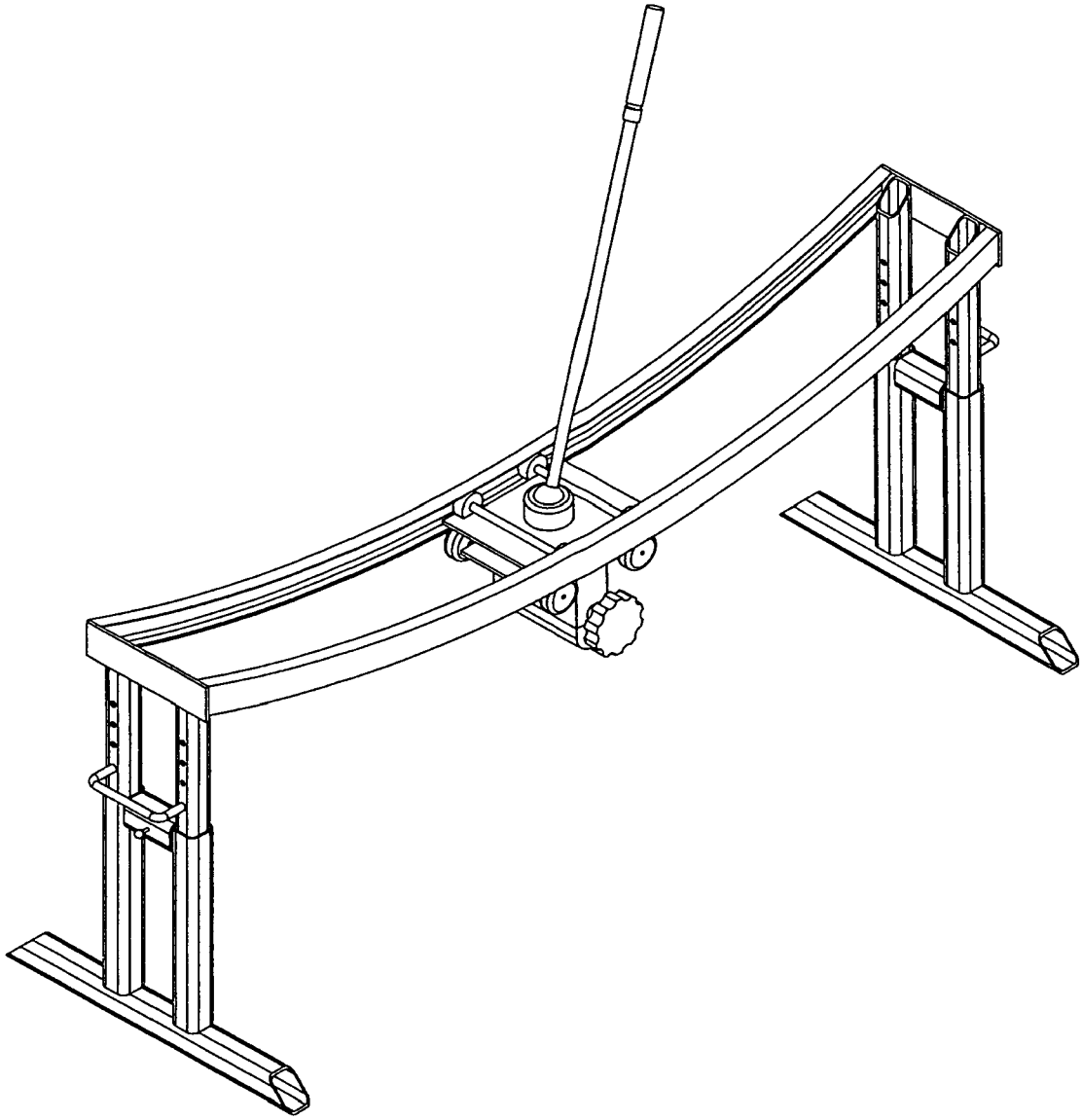
FIG. 2 is an isometric perspective view of the exercise apparatus of FIG. 1 with the top bed removed.
Figure 2A:
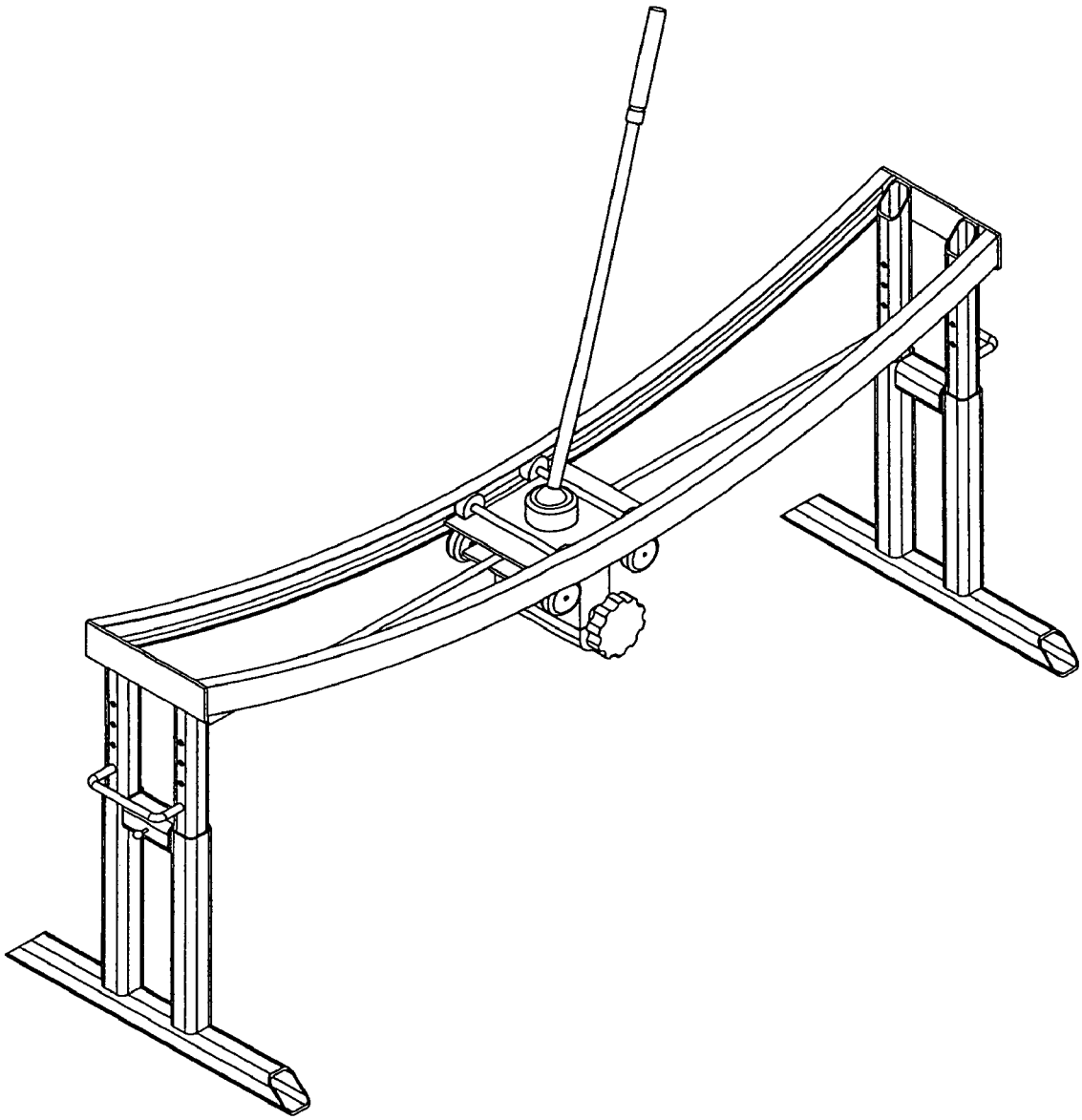
FIG. 2*a* is an isometric perspective view of FIG. 2 adding elastic bands or bungee cords from either end.
Figure 2B:
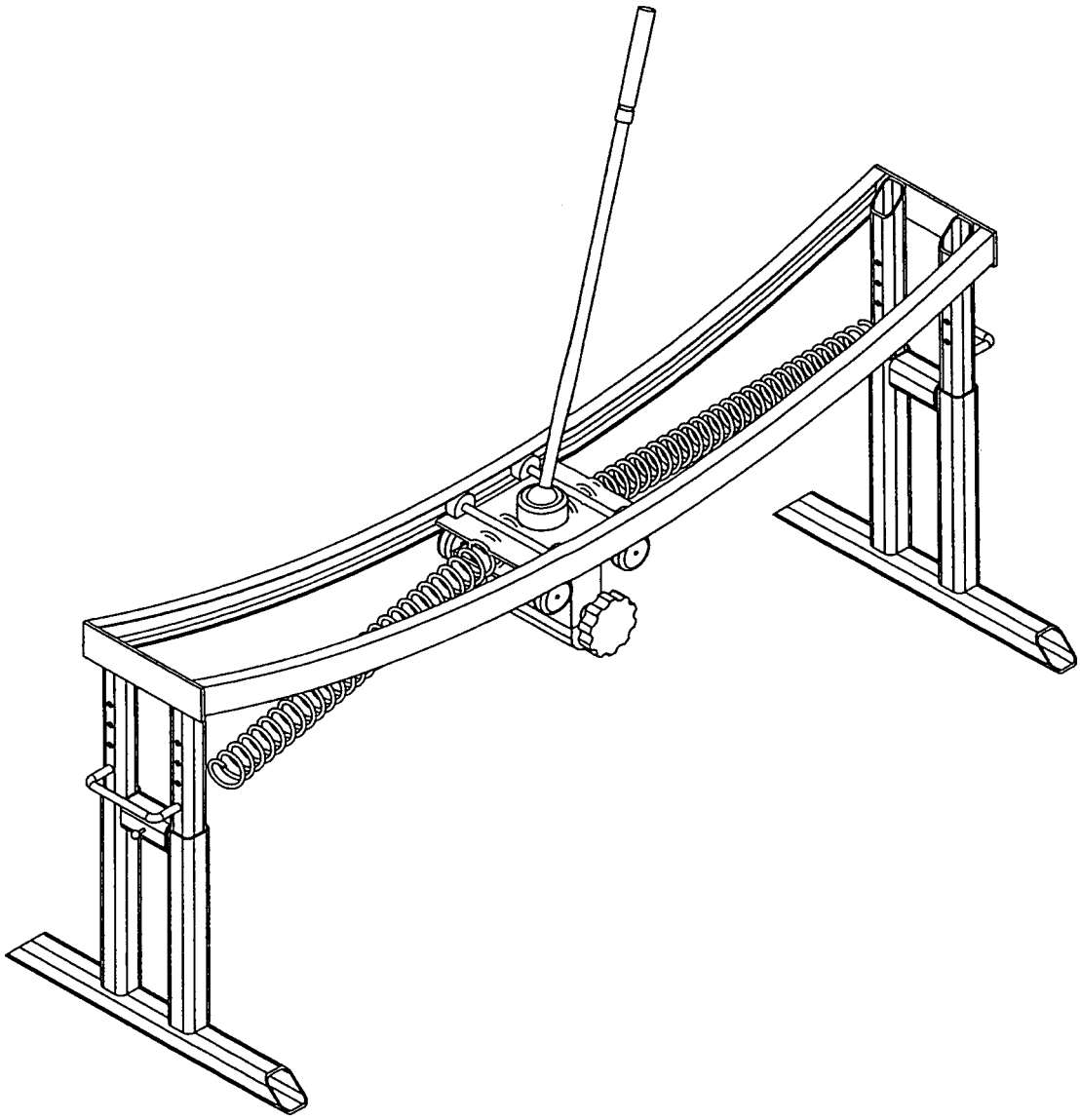
FIG. 2*b* is an isometric perspective view of FIG. 2 adding springs from either end.
Figure 2C:
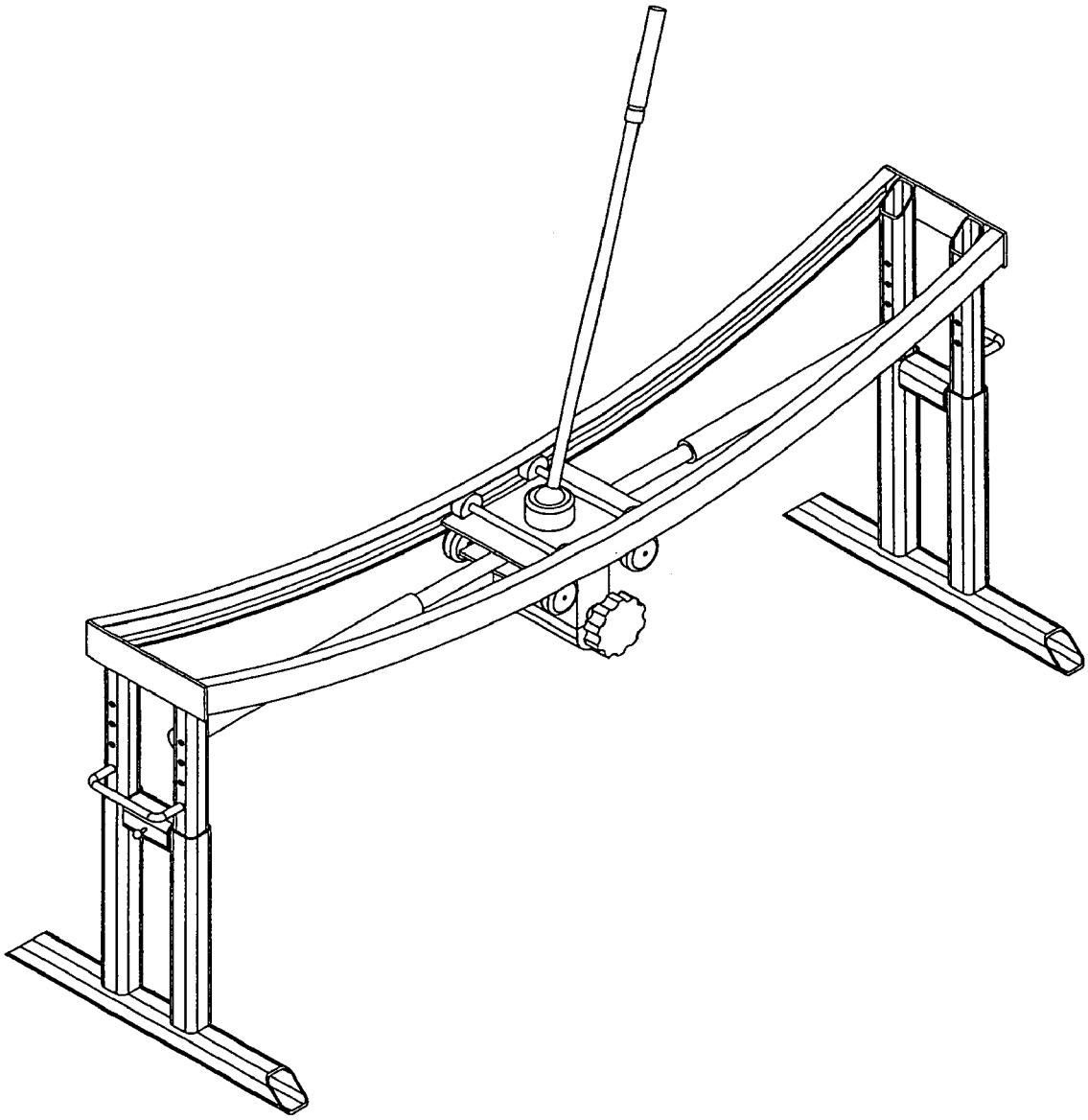
FIG. 2*c* is an isometric perspective view of FIG. 2 adding cylinders from either end.

Referring now to FIG. 2, the track 20 may comprise first and second parallel spaced apart rails 22 and 24, respectively. It will be appreciated however that the track may also comprise a single rail centrally locating the carriage. As illustrated in FIG. 2, the first and second rails 22 and 24 of the track 20 may each comprise a C-channel with their respective openings disposed towards each other.

Figure 3:
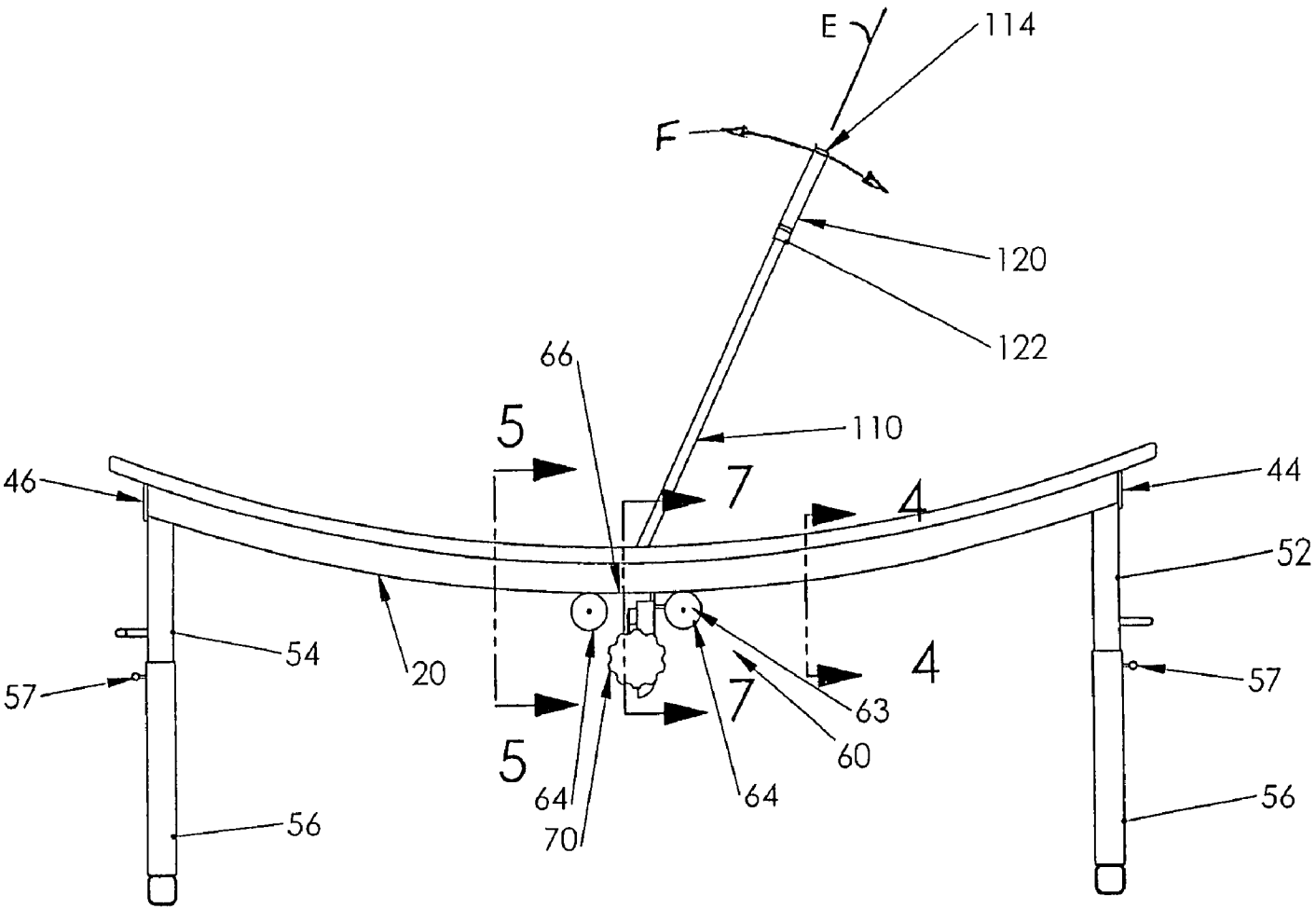
FIG. 3 is a side view of the exercise apparatus of FIG. 1.

Turning now to FIG. 3, the track 20 has first and second ends, 44 and 46, respectively. The track 20 including first and second ends 44 and 46, and first and second legs 52 and 54 depending therefrom, respectively together comprise the support frame 50. As illustrated in FIG. 3, the track 20 includes an upwardly concave curved or bowed profile wherein the middle portion of the track, indicated generally at 48 in FIG. 3, is at a lowermost height relative to the first and second ends 44 and 46. As illustrated, the track 20 has a constant radius of curvature between the first and second ends. It will be appreciated, however, that a curvature having a variable radius may also be useful. For example, the curvature of the track may be greater near the first and second ends 44 and 46 than at the middle portion 48. The curvature of the track 20 may also be greater at the middle portion 48 than at first and second ends 44 and 46 or portions of the track adjacent thereto.

As stated above, the support frame 50 comprises first and second legs 52 and 54. Each of the first and second legs may include a base portion 56 which telescopically and adjustably mounts onto each of the first and second legs 52 and 54. The base portions may each include a spring retaining pin 57 which engages in one of a plurality of adjusting holes 58 on the first and second legs 52 and 54. By selecting which of the adjusting holes 58 the retaining pins 57 are retained in, the height of the exercise apparatus 10 may be adjusted.

Figure 4:
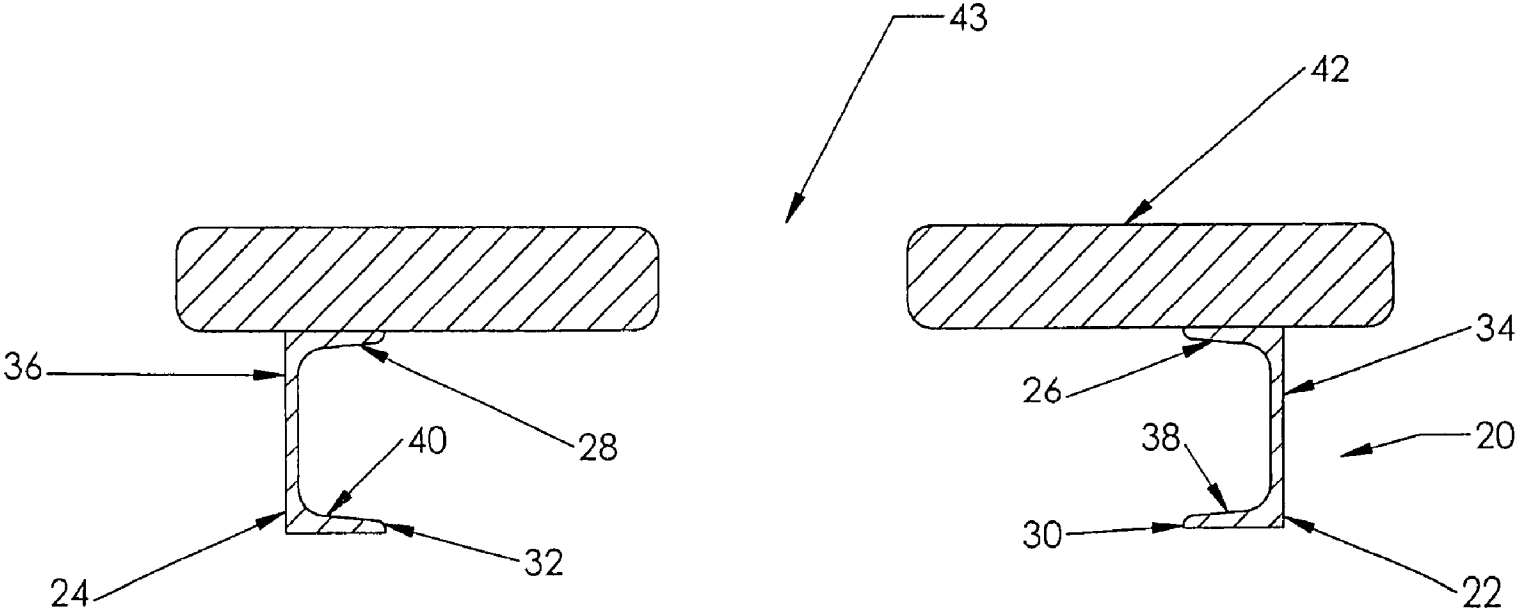
FIG. 4 is a cross section view of the exercise apparatus as taken along the line 4-4 of FIG. 3.

Turning now to FIG. 4, a cross-sectional view of the exercise apparatus 10 is shown as taken along the line 4-4 of FIG. 3. As stated above, the first and second rails 22 and 24 each comprise a C-channel with their respective openings disposed towards each other. The first and second rails 22 and 24 include top mounting flanges 26 and 28, respectively, first and second bottom support flanges 30 and 32, respectively and spanning portions 34 and 36, respectively therebetween. The first and second bottom support flanges 30 and 32 include first and second support surfaces 38 and 40, respectively which are adapted to support the moveable carriage 60 for displacement along the track 20. The top mounting flanges 26 and 28 support the top bed 42 with the elongate opening 43 disposed between the first and second rails 22 and 24.

Figure 5:
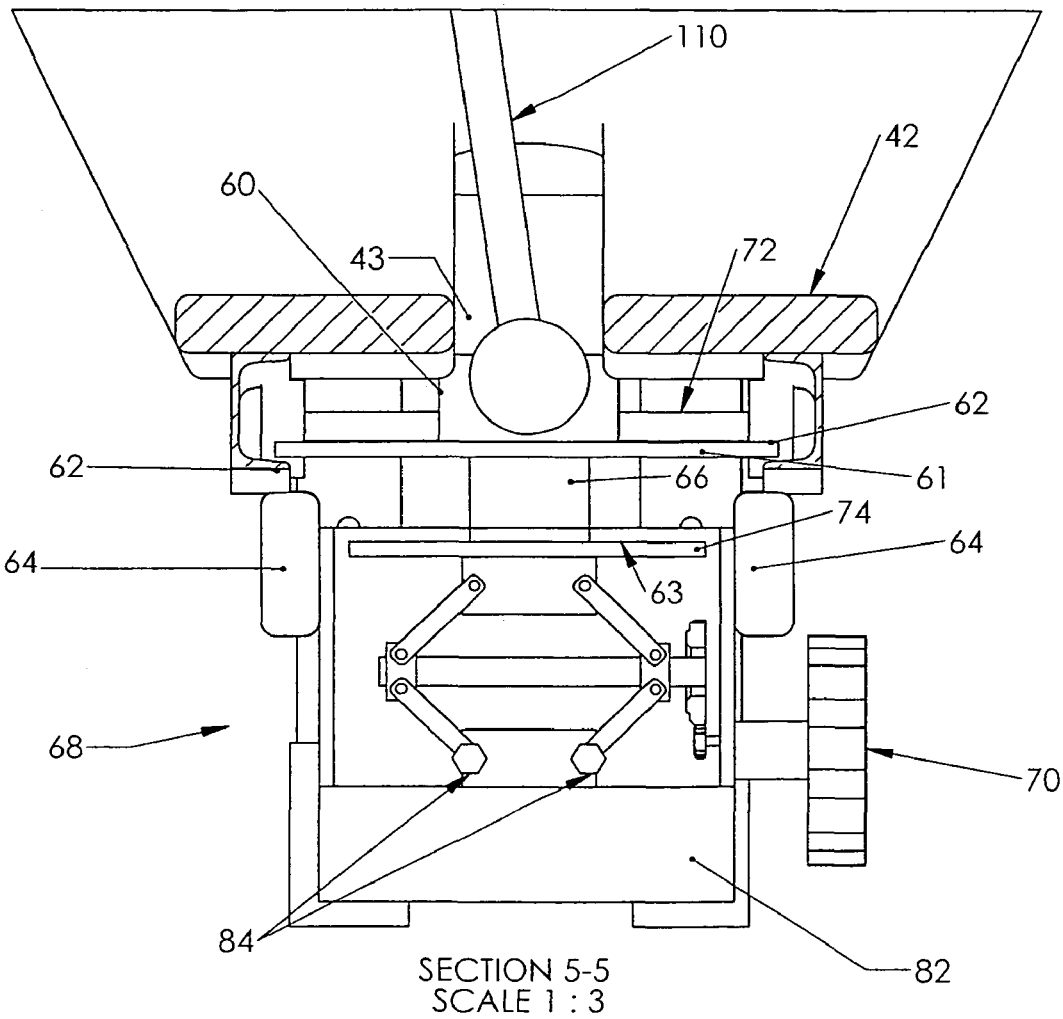
FIG. 5 is a cross section view of the exercise apparatus FIG. 1 as taken along the line 5-5 of FIG. 3.

FIG. 5 illustrates a cross-section of the exercise apparatus 10 as taken along the line 5-5 of FIG. 3 with the movable carriage 60 located between and supported by the first and second rails 22 and 24. The carriage 60 comprises parallel spaced apart top and bottom carriage plates 61 and 63, respectively. The top carriage plate 61 supports support wheels 62 adapted to rest upon and be supported by the support surfaces 38 and 40 of the first and second rails 22 and 24. The bottom carriage plate 63 supports clamping wheels 64 which bear against an underside of the support flanges 30 and 32 of the first and second rails 22 and 24. The support wheels 62 are rotatably supported by bearings or other suitable means on top shafts 72 which are securely mounted to top carriage plate 61. The clamping wheels 64 are rotatably supported by bearings or other suitable means on bottom shafts 74 which are securely mounted to bottom carriage plate 63.

Two connecting plates 66 are mounted to and extend perpendicularly from a lower side of top carriage plate 61. The connecting plates 66 support a clamping mechanism 68 at a lower end thereof. The tensioning mechanism 68, better described below, adjustably supports the bottom carriage plate 63 whereby the height of the bottom carriage plate relative to the top carriage plate 61 may be adjusted by the turning tensioning dial 70. The bottom carriage plate 63 is adjustably positionable with respect to the top carriage plate 61 by means of the tensioning mechanism 68 such that the support wheels 62 and the clamping wheels 64 may apply an adjustable clamping force upon, so as to selectively clamp therebetween, the support flanges 30 and 32 of the first and second rails 22 and 24.

The clamping wheels 64 may be formed of a pliable material such as, polyurethane, nylon, polyethylene, or other types of plastics and electrometric [elastomeric] materials, for example. The pliability or resistance of the clamping wheels 64 serves to increase the rolling resistance of the clamping wheels on the support flanges 30 and 32 so as to increase the resistance to movement of the carriage 60 on the track 20. As a greater clamping force is applied by the clamping mechanism 68 the clamping wheels 64 will have a greater rolling resistance on the support flanges 30 and 32 thereby providing greater resistance for the user. The support wheels 62 may comprise a metal roller bearing thereby having a low rolling resistance on the support surfaces 38 and 40. It will be appreciated that the support wheels 62 may also be formed of a pliable material while the clamping wheels 64 comprise a metal roller bearing or that both the support and clamping wheels may be formed of a pliable material. It will also be appreciated that sliders or skids or other friction means will also be useful in place of the support wheels or clamping wheels.

Figure 6:
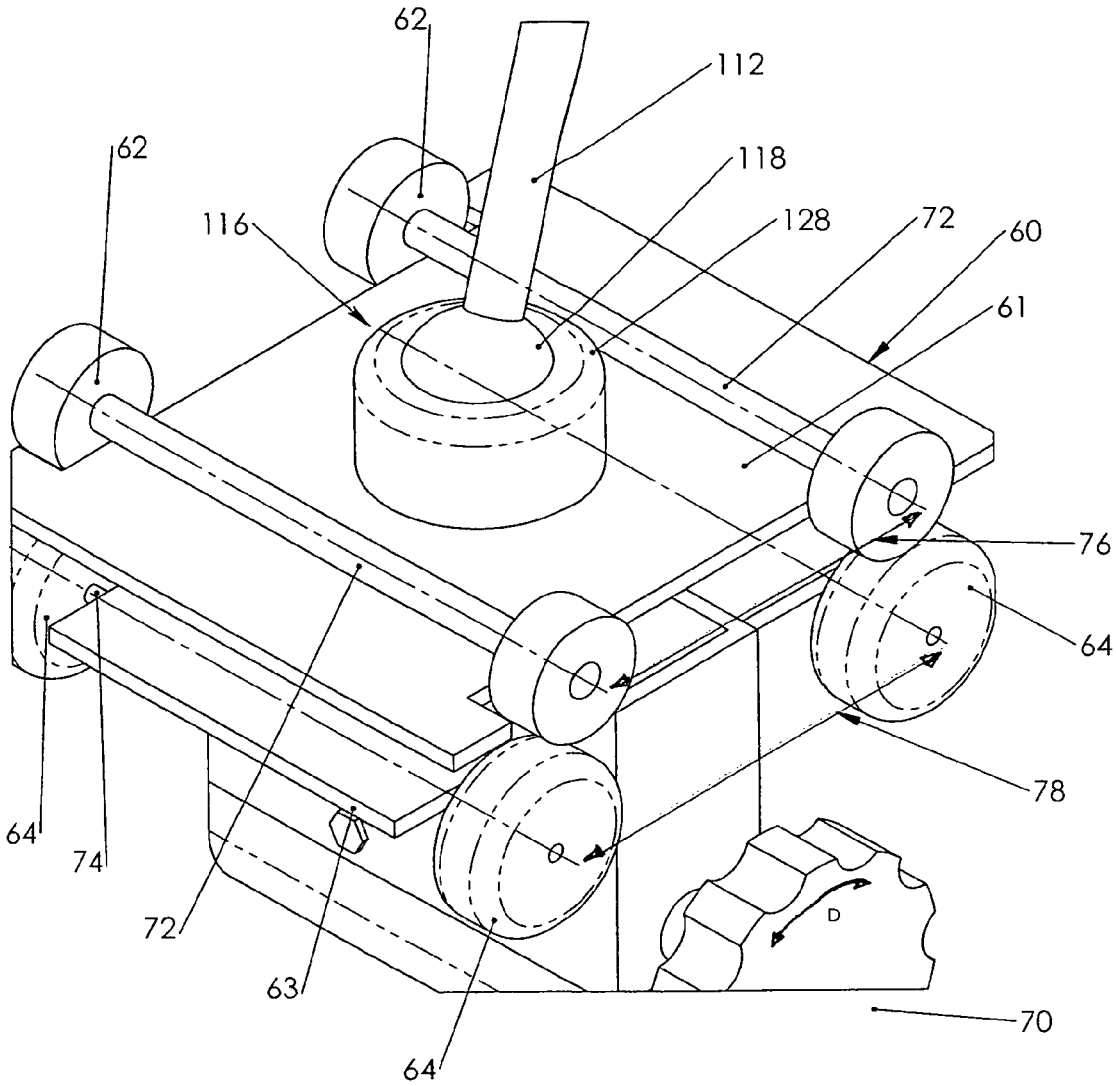
FIG. 6 is an isometric view of the carriage of the exercise apparatus of FIG. 1.

Now turning to FIG. 6, a perspective view of one embodiment of the carriage 60 is shown. As illustrated in FIG. 6, the support wheels 62 are separated by a first longitudinal distance indicated at 76. The clamping wheels 64 are separated by a second longitudinal distance indicated at 78. As illustrated in FIG. 6, the distance 76 is shorter than the distance 78. In addition, both of the support wheels 62 are located within the distance spanned by the clamping wheels 64. Accordingly, it can be seen that the contact points of the support wheels 62 are located inside region defined by the contact points of the clamping wheels 64.

Figure 7:
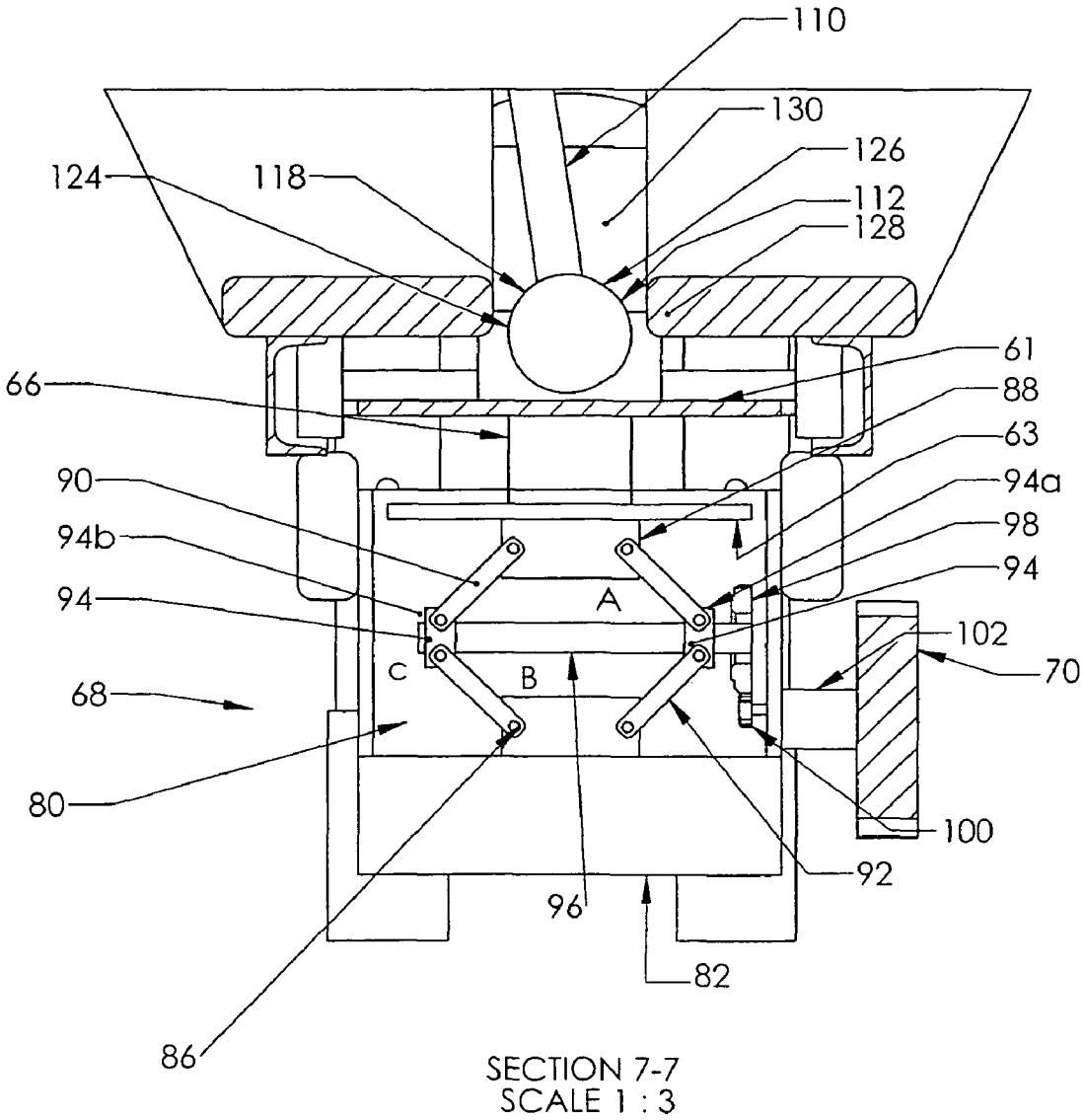
FIG. 7 is a cross section view of the exercise apparatus of FIG. 1 as taken along the line 7-7 of FIG. 3.
Figure 9:
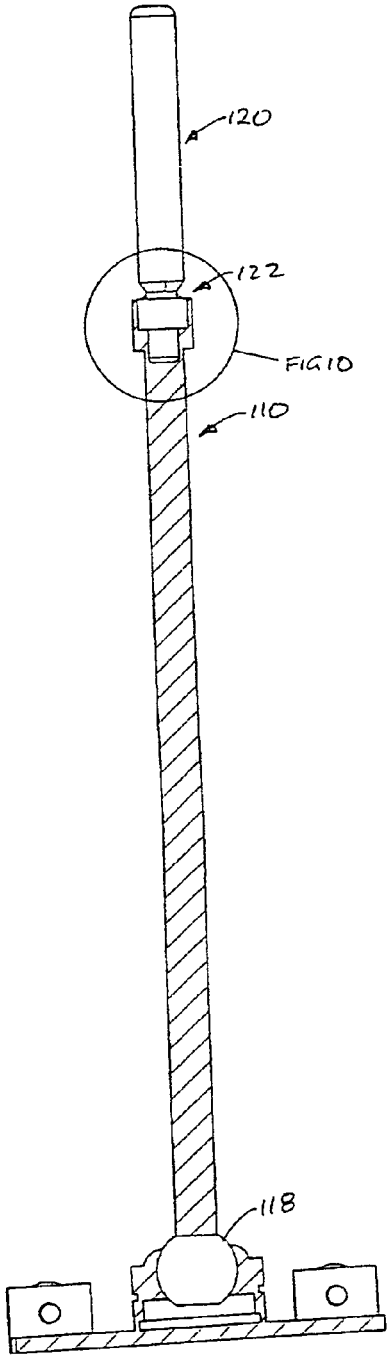
FIG. 9 is a section view along line 9-9 in FIG. 8, with the exception of the handle and bearing.
Figure 8:
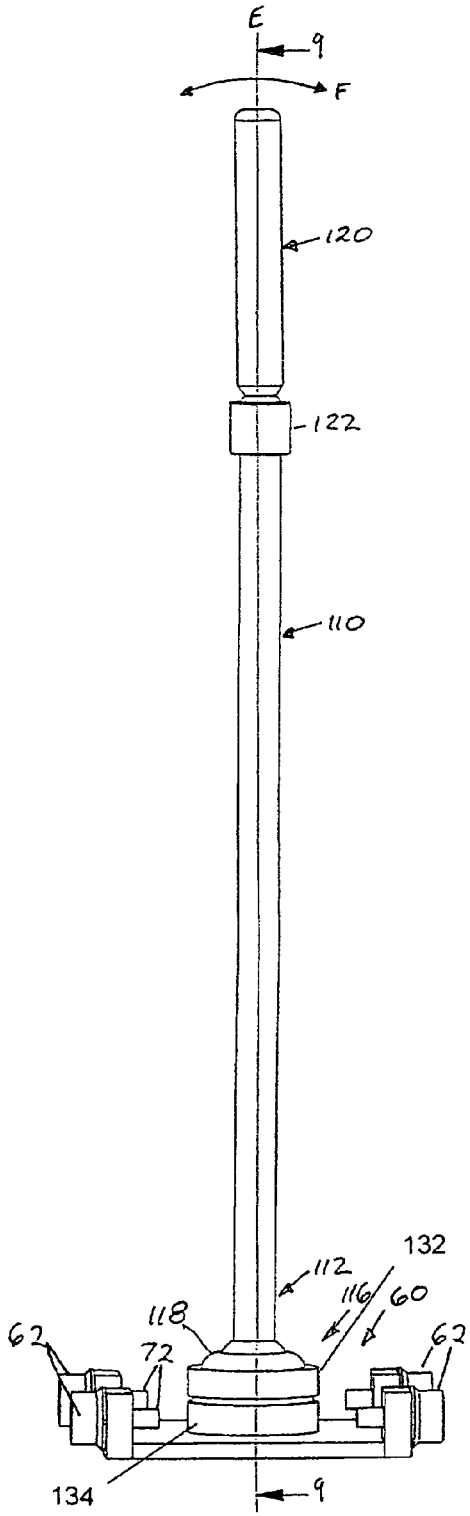
FIG. 8 is a front perspective view of the arm and carriage of the exercise apparatus.
Figure 10:
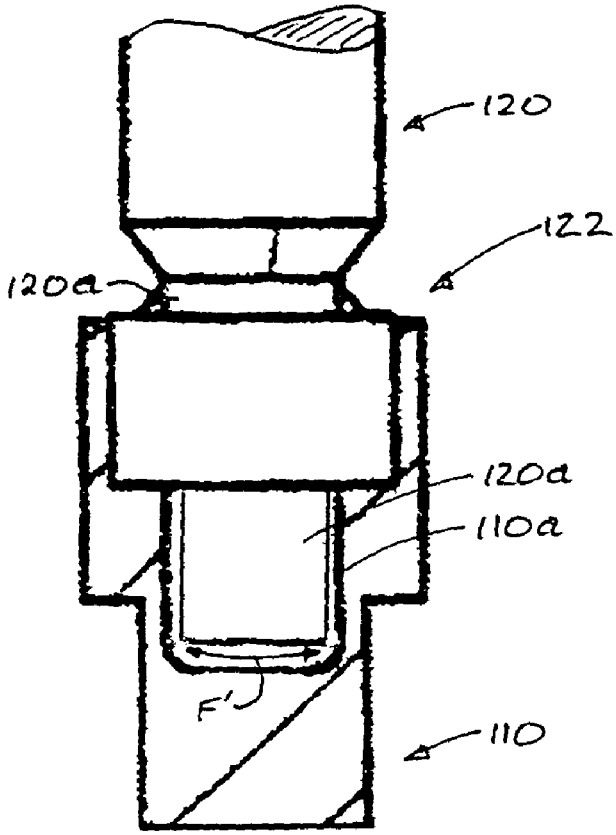
FIG. 10 is an enlarged view of a portion of FIG. 9.

Referring to FIG. 7, a cross sectional view of the tensioning mechanism 68 is shown according to one embodiment of the present invention. The tensioning mechanism comprises a scissor jack 80 suspended from the connecting plates 66 located within a cover 82. The scissor jack 80 and cover 82 are mounted to the connecting plates 66 my means of bolts 84 as shown in FIG. 5 which are passed through bottom bolt holes 86 of the scissor jack 80. The scissor jack includes a jack top 88 adapted to engage upon the bottom surface of the bottom carriage plate 63 so as to bear it in direction A towards the top carriage pate 61 when the scissor jack 80 is expanded by the driving of blocks 94 toward each other.

In particular, the scissor jack 80 includes top and bottom arms 90 and 92, pivotally mounted to so as to be connected to each other by jack blocks 94. The jack blocks 94 are internally threaded and connected to each other by a threaded jack screw 96 which is rotatably located in jack block 94*a* and threadably located within the other jack block 94*b*. Rotating the jack screw 96 about its longitudinal axis drives block 94*b* in direction B to vary the distance between the jack blocks 94 so as to correspondingly vary the height in direction C of jack screw 96 thereby also adjusting the height of the bottom carriage plate 63 relative to the top carriage plate 61. Jack gear 98 is mounted on one end of jack screw 96. Jack gear 98 engages a dial gear 100. The dial gear 100 and dial 70 are mounted on a common dial shaft 102. Turning dial 70 in direction D rotates shaft 102 and correspondingly, screw 96. It will be appreciated that any other types of devices capable of urging one plate towards another will also be useful as a clamping mechanism for providing resistance to the movement along the rails of the carriage 60.

Arm 110 extends pivotally from the carriage 60. The arm 110 comprises an elongate bar having a first end 112 pivotally connected to the carriage and a second free distal end 114. The second end of the arm may include a handle 120. The handle 120 may be substantially collinear with the arm and may be rotatably connected to the arm by an inline bearing 122. The inline bearing 122 permits rotation of the handle 120 relative to the arm 110 about a common axis E. The inline bearing 122 may also permit a small degree of rotation of the handle 120 in direction F for example by approximately 10 degrees in total rotation in direction F relative to linear alignment with the arm 110. Pin 120*a* extends from handle 120 through bearing 122 and into bore 110*a* formed in the upper end of arm 110. Pin 120*a* is sized to allow clearance of for example 1/16 of an inch around the pin within the bore thereby allowing movement of the pin within the bearing. This allows for pivoting of the handle in direction F as the pin pivots in direction F' within the bore. The first end 112 of the arm 110 is pivotally mounted to the carriage 60 by a ball and socket joint generally indicated at 116.

Referring to FIG. 7, an exploded cross sectional view of the ball and socket joint 116 is shown. The ball and socket joint 116 includes a substantially spherical ball 118 located on the first end 112 of the arm 110. A socket 124 is secured to or formed on the top of the carriage 60. The socket 124 provides a generally spherical void generally indicated at 126 having a shape generally cooperating with the ball 118. The socket further includes a retaining flange 128 surrounding the socket opening 130 through which the arm 110 passes. The socket may also comprise top and bottom socket halves 132 and 134, respectively. The bottom socket halve 132 may form the bottom portion of the socket void 126 and may have an opening corresponding to the diameter of the ball 118 so as to permit the placement of the ball in the bottom halve. The top socket halve may form the remainder of the void 126 and may have a bottom opening corresponding to the opening of the bottom socket halve and may include the socket opening 130. The top socket halve 134 will serve to retain the ball 118 within the socket 124. The top and bottom socket halves 132 and 134 may be secured to each other by any commonly know manner such as threadably securing the top halve to the bottom halve, for example.

Operation

Figure 1A:
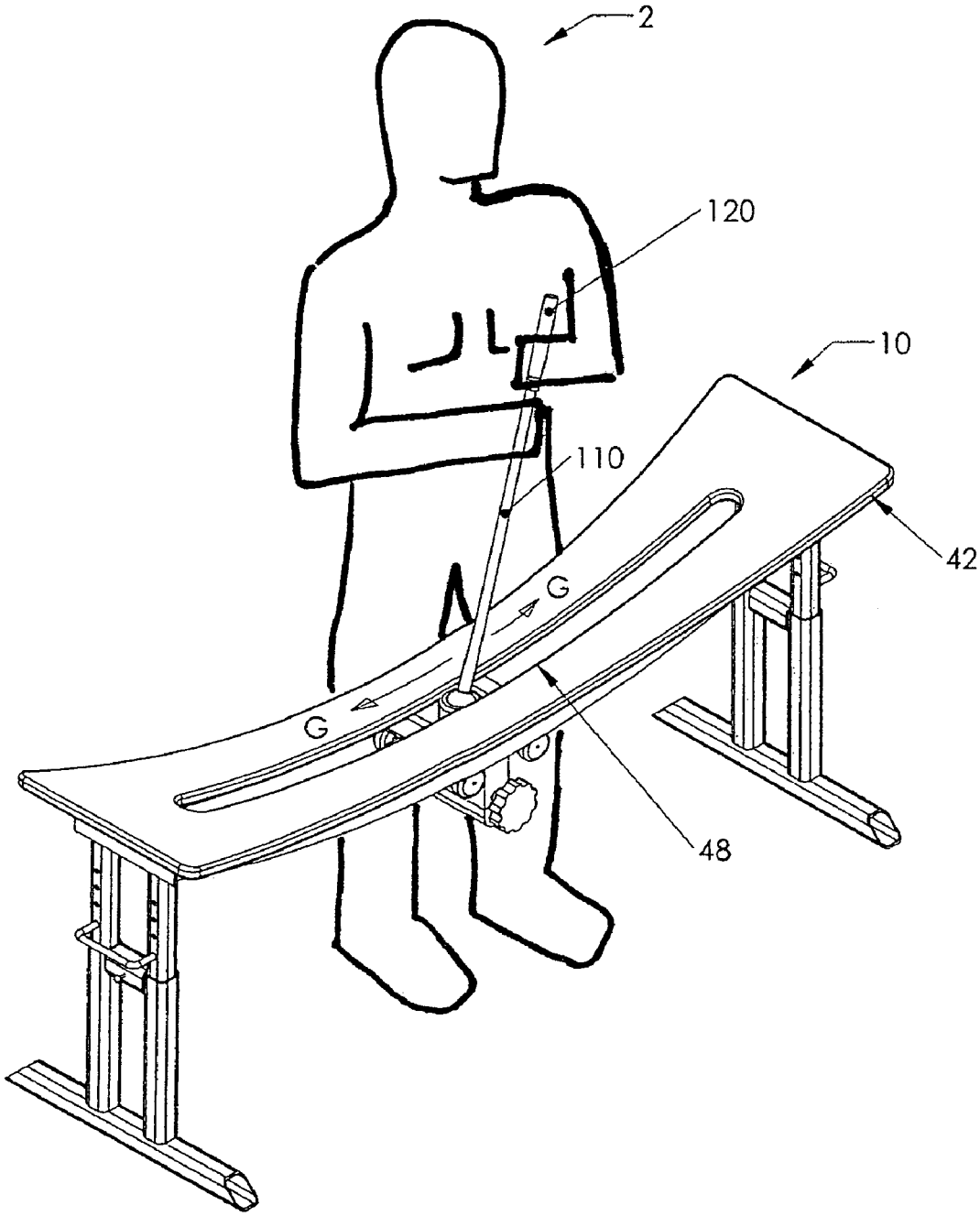
FIG. 1*a* is the view of FIG. 1 showing the exercise apparatus in use by a user.

In operation, a user 2 shown diagrammatically in FIG. 1*a* stands facing the exercise apparatus 10 with the track 20 oriented perpendicular or transverse to the forward direction of the user. The user is positioned proximate to the middle portion 48 of the track. The user grasps the arm 110 with either of their left or right hand at a position below the inline bearing 122 and grasps the handle 120 with the other of their left or right hand. The user's right and left hands both grasp the arm or handle on opposite sides of the arm with the palms of each hand disposed toward each other.

To perform an oblique exercise with the exercise apparatus 10, the user positions the handle 120 at a position substantially above the track 20 and substantially proximate to the centerline of his or her body. It can be seen that at this position the arm 110 is substantially vertical. The user then reciprocatingly moves the hand grasping the arm 110 in alternating directions G corresponding to the path of the track 20 while maintaining the handle 120 at a substantially fixed position.

In order to move the carriage 60 towards the direction corresponding to the handle grasping hand of the user, the user's arm grasping hand will push on the arm with their palm. To move the carriage back towards the middle portion and thereafter towards the direction corresponding to the user's arm grasping hand, the user's arm grasping hand will pull on the arm with their fingers. The resulting motion of the users handle and arm grasping hands may be similar to the motion of mopping a floor, with the exception that handle 120 rotates to a more vertical orientation than the orientation of arm 110 as the arm moves away from the center of the arc of the carriage track. The more vertical re-positioning of the handle 120 relative to the arm 110 during the lateral portions of the arc allows for a more solid grasping of the handle 120 by the upper hand of the user so as to more solidly resist the pulling and pushing of the arm 110 by the lower hand of the user. Without the vertical repositioning in direction F of handle 120 the handle would tend to twist out of the upper hand of the user.

It will be observed that in order to displace the carriage 60 towards the first or second ends 44 or 46 by rotation of the arm 110, the user will rotate their torso in the direction corresponding to the end towards which the carriage 60 is being urged. The user will thereafter rotate their torso back towards a neutral forward orientation as the carriage is returned to the middle portion 48 of the track 20.

It will be observed that the user's twisting motion of the torso as the carriage 60 is urged towards the end of the track 20 corresponding to the user's hand grasping the arm 110 is different than the user's twisting motion of the torso as the carriage is urged towards the end corresponding to the user's handle grasping hand. The user may therefore also reposition their hands such that the hand formerly grasping the handle 120 now grasps the arm 110 and the hand formerly grasping the arm 110 now grasps the handle 120. Thus, the two different twisting motions of the torso of the user as indicated above will be performed to both of the user's right and left hand side so as to ensure that each side of the user performs the same exercises.

The dial 70 may be adjusted so as to apply a greater clamping force on the support flanges 30 and 32 of the first and second rails 22 and 24 between the support wheels 62 and clamping wheels 64. The greater clamping force adds resistance to the movement of the carriage 60 on the track 20 and therefore requires that the user exert a greater force to move the carriage away from the middle portion 48 of the track. A user progressively increases the resistance as, with use over time, the user becomes stronger and more fit.

The height of the exercise apparatus 10 may also be adjusted by means of the retaining pins 57 and adjusting holes 58. The height of the exercise apparatus 10 may be adjusted so as to be adapted for users of differing heights. The height of the exercise apparatus may also be adapted so as to vary the dominant muscles exercised by the exercise apparatus. For example, with a higher exercise apparatus, the user will utilize and therefore provide greater training to the exterior oblique muscles. Similarly, with a lower exercise apparatus, the user will utilize and therefore provider greater training to the interior oblique muscles. The curvature of the track more effectively exercises the oblique muscles when completing a stroke and beginning a new stroke. The tension mechanism is designed to eliminate the effects of gravity in the stroke and keep the resistance consistent the whole way through.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for exercising the oblique abdominal muscles of a user, the apparatus comprising:

a curved elongate track having first and second ends and a middle portion, said elongate track being positionable transverse to a user;

a carriage movable along said track, said carriage being biased toward said middle portion of said track;

an arm extending substantially vertically and perpendicular from said carriage and having a base end and an opposite free distal end, and wherein said arm is elongate and substantially linear and provides spaced apart first and second gripping portions separated along the length of said arm, and wherein said first gripping portion is a handle at said free distal end and said second gripping portion is spaced between said base end and said handle;

wherein said base end is mounted to said carriage by a joint for pivoting said arm relative to said carriage in a pivoting motion substantially that of mopping a floor using said arm, whereby the application by the user of an alternating mopping motion torque applied to said first and second gripping portions of said arm urges said carriage in a corresponding reciprocating motion on said track;

wherein said joint means includes a ball and socket joint;

wherein said handle is rotatably secured to said arm for free rotation of said handle relative to said second gripping portion during said pivoting motion of said arm, and wherein said handle is pivotally secured to said arm whereby said handle is pivotable out of said collinearity with said arm; a resistor for resisting the movement of said carriage along said track, said resistor comprises retaining at least a portion of said track between at least two wheels mounted on said carriage, at least one of said at least two wheels having a rolling friction resistance on said track, said at least one of said at least two wheels is adjustably engaged upon said track by a clamping mechanism for changing rolling friction resistance between said track and said wheels, and said clamping mechanism comprising a scissor jack.

2. The apparatus of claim 1 wherein said elongate track has a curvature which is upwardly concavely curved.

3. The apparatus of claim 2 wherein said middle portion is lower than said ends of said track.

4. The apparatus of claim 3 wherein said track is arcuate.

5. The apparatus of claim 4 wherein said curvature of said track has a constant radius.

6. The apparatus of claim 1 wherein said track comprises a pair of parallel spaced apart rails.

7. The apparatus of claim 6 wherein said rails further include parallel spaced apart support portions for supporting said carriage.

8. The apparatus of claim 6 wherein said arm extends from said carriage through a passage between said pair of rails.

9. The apparatus of claim 1 wherein said carriage further includes sliders slidably engaging said track.

10. The apparatus of claim 1 wherein said carriage further includes wheels rollably engaging said track.

11. The apparatus of claim 10 wherein said carriage includes support wheels and clamping wheels with a support portion retained therebetween.

12. The apparatus of claim 11 wherein at least one of said support wheels or said clamping wheels comprise a pliable material.

13. The apparatus of claim 12 wherein said clamping wheels comprise a pliable material.

14. The apparatus of claim 12 wherein said pliable material comprises polyurethane.

15. The apparatus of claim 1 wherein said resistor comprises a friction inducing means between said track and said carriage.

16. The apparatus of claim 1 further comprising a biasing element for biasing said carriage towards said middle portion of said track.

17. The apparatus of claim 16 wherein said biasing element is selected from the group consisting of springs, elastomeric bands or pneumatic or hydraulic cylinders.

18. The apparatus of claim 1 wherein said handle is pivotable by substantially 10 degrees out of said collinearity with said arm.

* * * * *